US006313694B1

(12) United States Patent
Sohn

(10) Patent No.: US 6,313,694 B1
(45) Date of Patent: Nov. 6, 2001

(54) INTERNAL POWER VOLTAGE GENERATING CIRCUIT HAVING A SINGLE DRIVE TRANSISTOR FOR STAND-BY AND ACTIVE MODES

(75) Inventor: Kyo-Min Sohn, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/399,925

(22) Filed: Sep. 21, 1999

(30) Foreign Application Priority Data

Sep. 24, 1998 (KR) ..... 98-39751

(51) Int. Cl.[7] ..... G05F 1/10
(52) U.S. Cl. ..... 327/541; 327/540; 323/316
(58) Field of Search ..... 327/540, 541, 327/544, 545, 546; 323/312, 316

(56) References Cited

U.S. PATENT DOCUMENTS 5,254,883 * 10/1993 Horowitz et al. ..... 327/541
5,307,315 * 4/1994 Oowaki et al. ..... 327/541
5,317,254 * 5/1994 Olson ..... 323/316
5,335,203 * 8/1994 Ishii et al. ..... 327/541
5,493,234 * 2/1996 Oh ..... 327/541
5,506,541 * 4/1996 Herndon ..... 327/541

* cited by examiner

*Primary Examiner*—Terry D. Cunningham
(74) *Attorney, Agent, or Firm*—Marger Johnson & McCollom, P.C.

(57) ABSTRACT

An internal power voltage generating circuit for a semiconductor device reduces current consumption during stand-by mode and allows a fast transition to active mode by using a single output driver for both standby mode and active mode. The output driver is coupled to both an active mode comparison circuit, which is disabled during stand-by-mode, and a stand-by mode comparison circuit which is enabled during stand-by-mode. The active mode comparison circuit is fabricated from large transistors and generates a first output signal having a high current capacity to turn the output driver completely on. The stand-by mode comparison circuit is fabricated from small transistors and generators a second output signal having a low current capacity which only turns the output driver partially on. The output driver can switch quickly from stand-by-mode to active mode because it is not turned completely off during stand-by-mode. This also eliminates the need for an additional circuit for turning the driver completely off. The stand-by-mode comparison circuit can by left on during active mode without influencing the output driver because the current capacity of its output signal is small compared to that of the active mode comparison circuit.

3 Claims, 4 Drawing Sheets

INTERNAL POWER VOLTAGE GENERATING CIRCUIT HAVING A SINGLE DRIVE TRANSISTOR FOR STAND-BY AND ACTIVE MODES

This application claims priority from Korean patent application No. 98-39751 filed Sep. 24, 1998 in the name of Samsung Electronics Co., Ltd., which is herein incorporated by reference.

BACKGROUND OF THE INVENTION

1. Field of the Invention

The present invention relates generally to internal power voltage generating circuits for semiconductor devices, and more particularly, to an internal power voltage generating circuit that uses a single drive transistor to reduce power consumption during stand-by mode and to reduce the transition time from stand-by mode to active mode.

2. Description of the Related Art

An internal power voltage generating circuit in a semiconductor memory device generates an internal power voltage which remains constant regardless of changes in the external power supply voltage. Considerable current flows through the internal power voltage generating circuit in order to supply a stable voltage to the semiconductor memory device.

When a semiconductor memory device operates in an active mode in which read and write operations are performed, it consumes significantly more current than in a standby mode during which it simply stores cell data. Continuous efforts have been made to reduce current consumption during standby mode.

A conventional internal power voltage generating circuit has separate output drivers and comparison circuits for standby and active modes. An additional circuit is required to turn the output driver for active mode completely off during standby mode. For example, the conventional internal power voltage generating circuit shown in FIG. 1, which will be described more thoroughly below, includes an additional transistor 20 which turns the active mode output driver 14 completely off during standby mode.

A problem with the conventional circuit of FIG. 1, however, is that the additional transistor 20 creates a current path through comparison circuit 10 during standby mode, thereby causing unnecessary current consumption during standby mode, Because the comparison circuit 10 is constructed with large transistors, a considerable amount of current flows through the comparison circuit 10 during standby mode.

An additional problem with the circuit of FIG. 1 is that it cannot switch quickly from standby mode to active mode because the output driver is turned completely off during standby mode.

FIG. 3 shows a conventional internal power voltage generating circuit having a PMOS output driver 34 and an additional transistor 38 for turning the output driver completely off during standby mode. As with the circuit of FIG. 1, the circuit of FIG. 3 cannot switch quickly from standby mode to active mode because the output driver 34 is turned completely off during standby mode.

Therefore, the conventional internal power voltage generating circuits of FIGS. 1 and 3 are not suitable for use in high-speed semiconductor memory devices.

SUMMARY OF THE INVENTION

It is therefore an object of the present invention to reduce current consumption in an internal power voltage generating circuit during standby mode.

Another object of the present invention is to provide an internal power voltage generating circuit which can switch rapidly from standby mode to active mode.

To achieve these and other objects, an internal power voltage generating circuit in accordance with the present invention uses a single output driver for both standby mode and active mode.

The output driver is coupled to both an active mode comparison circuit which is disabled during stand-by-mode, and to a stand-by mode comparison circuit which is enabled during stand-by mode. The active mode comparison circuit is fabricated from large transistors and generates a first output signal having a high current capacity to turn the output driver completely on. The stand-by mode comparison circuit is fabricated from small transistors and generates a second output signal having a low current capacity which only turns the output driver partially on. The output driver can switch quickly from stand-by mode to active mode because it is not turned completely off during stand-by mode. This also eliminates the need for an additional circuit for turning the driver completely off. The stand-by mode comparison circuit can by left on during active mode without influencing the output driver because the current capacity of its output signal is small compared to that of the active mode comparison circuit.

BRIEF DESCRIPTION OF THE DRAWINGS

Throughout the drawings, like reference numerals and symbols are used to designate like or equivalent parts or portions, and for simplicity of illustration and explanation, redundant references will be omitted.

DETAILED DESCRIPTION

Figure 1:
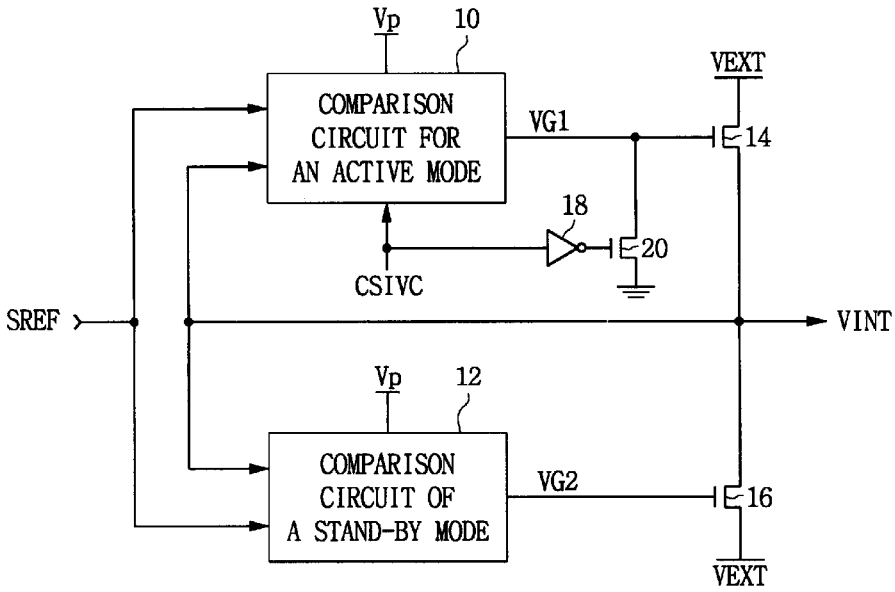
FIG. 1(PRIOR ART)
FIG. 1 is a block diagram of a conventional internal power voltage generating circuit having an NMOS transistor for an output driver.

FIG. 1 is a block diagram of a conventional internal power voltage generating circuit having a differential comparison circuit 10 for active mode, a differential comparison circuit 12 for standby mode, an NMOS transistor output driver 14, NMOS transistors 16 and 20, and an inverter 18. The differential comparison circuit for active mode 10 is disabled during standby mode and activated in response to a control signal CSIVC during active mode. This circuit 10 generates a first output signal VG1 by comparing a comparative reference voltage SREF and the internal power voltage VINT. The NMOS output driver transistor 14 has a drain connected to an external power voltage VEXT, a gate coupled to receive the first output signal VG1 and a source for providing the internal power voltage VINT. Output driver 14 transforms the external voltage VEXT to the internal power voltage VINT in response to the first output signal VG1. The differential comparison circuit 10 is energized by a stepped up voltage Vp. When the voltage level of the first output signal VG1 increases, the output driver 14 is turned completely on in order to obtain sufficient current driving capacity.

During standby mode, the control signal CSVIVC goes low, and the output signal from inverter 18 switches to high, thereby turning NMOS transistor 20 on and applying a power supply ground voltage GND to the gate of NMOS transistor 14. As a result, NMOS transistor 14 turns completely off, so no current flows through it during standby mode.

The differential comparison circuit 12 for standby mode operates at all times during active and standby modes. This circuit 12 generates a second output signal VG2 responsive to the difference between the comparative reference voltage SREF and the internal power voltage VINT. The output driver 16 for standby mode includes an NMOS transistor having a source coupled to the internal power voltage VINT, a gate coupled to receive the second output signal VG2 and a drain coupled to the external power voltage VEXT. Output driver 16 transforms the external voltage VEXT to the internal voltage VINT in response to the second output signal VG2 generated by the differential comparison circuit 12 for standby mode which is energized by a stepped voltage Vp.

A constant internal power voltage VINT is generated during active and standby modes. Because a large amount of current is needed during active mode, the transistors in the differential comparison circuit 10 and the output driver 14 for active mode are large to allow sufficient current flow. On the other hand, the transistors in the differential comparison circuit 12 and output driver 16 for standby mode are small.

Figure 2:
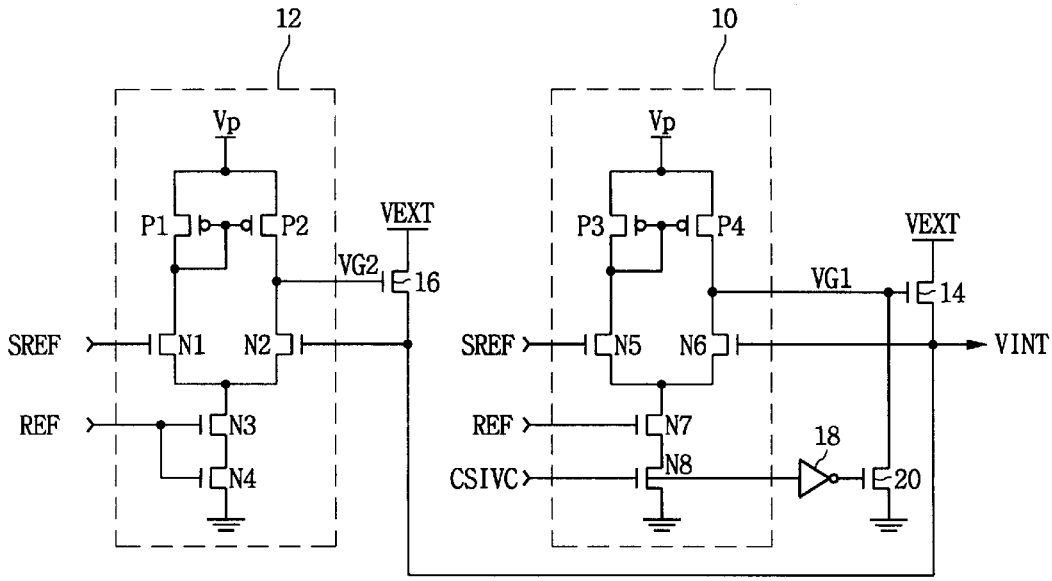
FIG. 2(PRIOR ART)
FIG. 2 is a circuit diagram illustrating more details of the circuit of FIG. 1.

FIG. 2 is a circuit diagram showing more details of the circuit of FIG. 1. The differential comparison circuit 10 for active mode includes PMOS transistors P3 and P4, and NMOS transistors N5, N6, N7 and N8. Differential comparison circuit 12 for standby mode includes PMOS transistors P1 and P2, NMOS transistors N1, N2, N3, N4, and an inverter 18. The output drivers N14 and N16 are also NMOS transistors.

The differential comparison circuit for stand-by mode includes a PMOS transistor P1 having a drain connected to stepped-up voltage Vp; a PMOS transistor P2 having a gate connected to the stepped-up voltage Vp and a gate connected to the gate of PMOS transistor P1; and NMOS transistor N1 having a gate to which the comparative reference voltage SREF is applied and a drain connected to the drain and gate of PMOS transistor P1; NMOS transistor N2 having a drain connected to the drain of PMOS transistor P2 and a gate connected to the internal power voltage VINT, and a source connected to the source of NMOS transistor N1; and NMOS transistor N3 having a gate connected to the reference voltage REF and a drain connected to the source of NMOS transistors N1 and N2; and an NMOS transistor N4 having a gate connected to the reference voltage REF, a drain connected to the source of NMOS transistor N3 and a source connected to the GND voltage.

The differential comparison circuit for the active mode is constructed in much the same manner as that for the standby mode. That is, the PMOS transistors P1, P2 respectively correspond to the PMOS transistors P3, P4 while the NMOS transistors N1, N2, N3, N4 correspond to the NMOS transistors N5, N6, N7, N8. The only difference between these two circuits is in that the voltages REF and CISVC are applied to the gates of the respective NMOS transistors N7, N8.

As described above, the transistors in the differential comparison circuit 10 and output driver 14 for active mode are larger, i.e., have a larger width than those used in the differential comparison circuit 12 and output driver 16 for standby mode, thereby resulting in larger current drive capacity.

The voltage level of the comparative reference voltage SREF is set to the level at which the internal power voltage VINT is to be generated. The voltage level of the reference voltage REF is set a little lower than that of SREF. The voltage levels of the signals SREF and REF as maintained at these levels during both standby and active mode. The control signal CSIVC is generated internally in response to an externally applied chip select signal CS. During active mode, the control signal CSIVC is active, i.e., high, in response to the chip select signal CS which is enabled. The high voltage level of CSIVC is the same as that of SREF. Therefore, NMOS transistors N3, N4 and N7 operate as constant current sources.

The operation of the internal power voltage generating circuit of FIG. 2 will now be described. During active mode, the control signal CSIVC is high, and both differential comparison circuits 10 and 12 operate. If the internal voltage VINT is lower than the comparative reference voltage SREF, the current flowing through transistor N5 becomes larger than that flowing through N6, thereby increasing the output voltage VG1. This causes the current flow through driver 14 to increase, thereby increasing the internal power voltage VINT. In contrast, if VINT is higher than SREF, the current flowing through transistor N5 becomes smaller than that through N6 thereby decreasing VG1. This causes the current through output driver 14 to decrease, thereby reducing the internal power voltage VINT.

During active mode, the differential comparison circuit 12 for standby mode also operates, and output drive 16 is turned on. Therefore, during active mode, the internal power voltage VINT is generated by the combined current capacity of output drivers 14 and 16.

During standby mode, the control signal CSIVC goes low, and the output signal of inverter 18 goes high, thereby turning on NMOS transistor 20 and pulling the voltage VG1 at the gate of output driver 14 to GND. Therefore, no current flows through output driver 14 because it is turned completely off.

However, when the gate-source voltage on transistors P3, N5, and N6 become greater than a threshold voltage, these transistors turn on, thereby creating a current path through transistors P3, N5, N6, and N20 which causes a great amount of current consumption due to the large size of these transistors.

Furthermore, a high-speed semiconductor memory device should be able to transition from stand-by mode to active mode in an extremely short period of time (approximately 10 ns). However, the output driver 14 for active mode cannot turn on this fast because it is turned completely off during standby mode.

Figure 3:
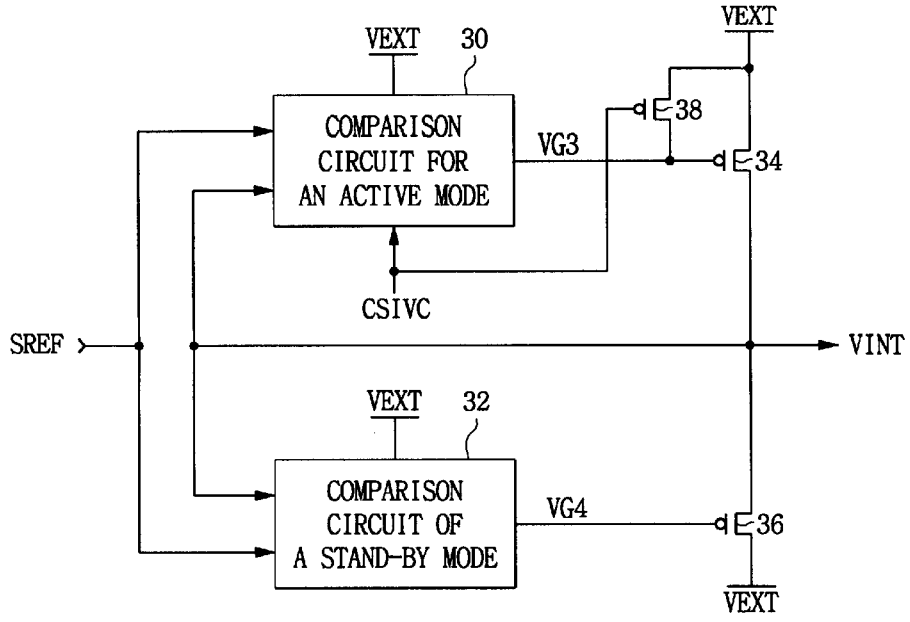
FIG. 3(PRIOR ART)
FIG. 3 is a block diagram of a conventional internal power voltage generating circuit having a PMOS transistor for an output driver.

FIG. 3 is a block diagram of a conventional internal power voltage generating circuit having a PMOS transistor for an output driver 34 for active mode, a PMOS transistor 38 for an output driver for standby mode, a differential comparison circuit 30 for active mode, a differential comparison circuit 32 for standby mode, and an additional PMOS transistor 36.

Figure 4:
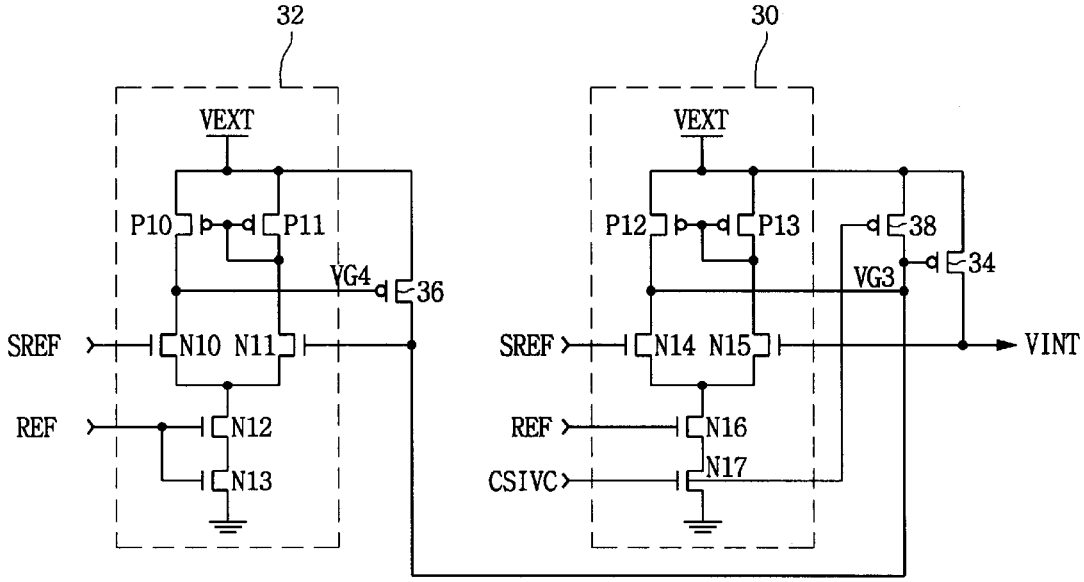
FIG. 4(PRIOR ART)
FIG. 4 is a circuit diagram showing more details of the circuit of FIG. 3.

FIG. 4 is a circuit diagram showing more details of the circuit of FIG. 3. The differential comparison circuit 30 for active mode includes PMOS transistors P12 and P13 and NMOS transistors N14, N15, N16 and N17. Differential comparison circuit 32 for standby mode includes PMOS transistors P10 and P11 and NMOS transistors N10, N11, N12 and N13.

The operation of the circuit of FIGS. 3 and 4 is similar to that of the circuit of FIGS. 1 and 2 with the following exceptions. Because the circuit of FIG. 4 utilizes PMOS output drivers, the differential comparison circuits 30 and 32 can be energized by the external power voltage VEXT instead of a stepped up voltage Vp. Also, when the control signal CSIVC goes low during standby mode, PMOS transistor 36 is turned on to apply the external power voltage VEXT to the gate of output driver 34, thereby turning it completely off.

In the circuit of FIG. 4, no current path is formed through the differential comparison circuit 30 for active mode during standby mode. However, because the output driver 34 for active mode is turned completely off during standby mode, the circuit of FIG. 4 cannot switch quickly from standby mode to active mode. Therefore, the circuit of FIG. 4, like the circuit of FIG. 2, is not suitable for use in high-speed semiconductor memory devices requiring a rapid transition from standby mode to active mode.

An internal power voltage generating circuit in accordance with the present invention, which will be described with reference in FIGS. 5–8, solves the problems described above.

Figure 5:
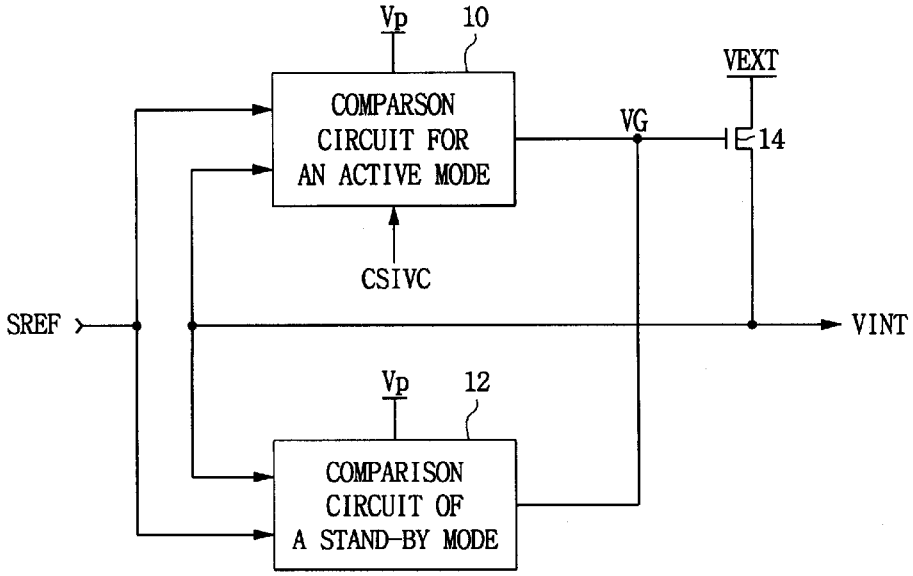
FIG. 5 is a block diagram of an embodiment of an internal power voltage generating circuit in accordance with the present invention having an NMOS transistor for an output driver.

FIG. 5 is a block diagram of an embodiment of an internal power voltage generating circuit in accordance with the present invention. The circuit of FIG. 5 is similar to that of FIG. 1, however, the output driver 16 for standby mode, the inverter 18, and transistor 20 are eliminated, and the first and second output signals from the differential comparison circuits 10 and 12 are both used to drive the gate of the output driver 14. In other words, the circuit of FIG. 5 uses a single output driver 14 for both active and standby modes.

During active mode, the control signal CSIVC is high and both differential comparison circuits 10 and 12 operate. However, because the differential comparison circuit 12 for standby mode is fabricated from transistors that are much smaller than those used in differential comparison circuit 10 for active mode, the signal from circuit 12 does not influence the driving of the large NMOS transistor output driver 14 which is dominated by the signal from comparison circuit 10.

During standby mode, the control signal CSIVC goes low and differential comparison circuit 10 for active mode is disabled. Therefore, the output driver 14 is controlled entirely by the output signal from the differential comparison circuit 12 for standby mode. It is difficult for the circuit 12 to control output driver 14 because its output signal is generally too small to control a large NMOS transistor. However, it is possible to properly control the output driver 14 using the output signal from circuit 12 during standby mode due to the small amount of current needed and the small fluctuation in the amount of current resulting during standby mode.

Furthermore, because the output driver 14 does not turn completely off (it is partially on) during standby mode, it can switch very rapidly to the complete on state, thereby reducing the transition time from standby mode to active mode.

Also, since the inverter 18 and additional transistor 20 shown in FIG. 1 is eliminated from the circuit of FIG. 5, the additional current consumption caused by these components during standby mode is eliminated.

Figure 6:
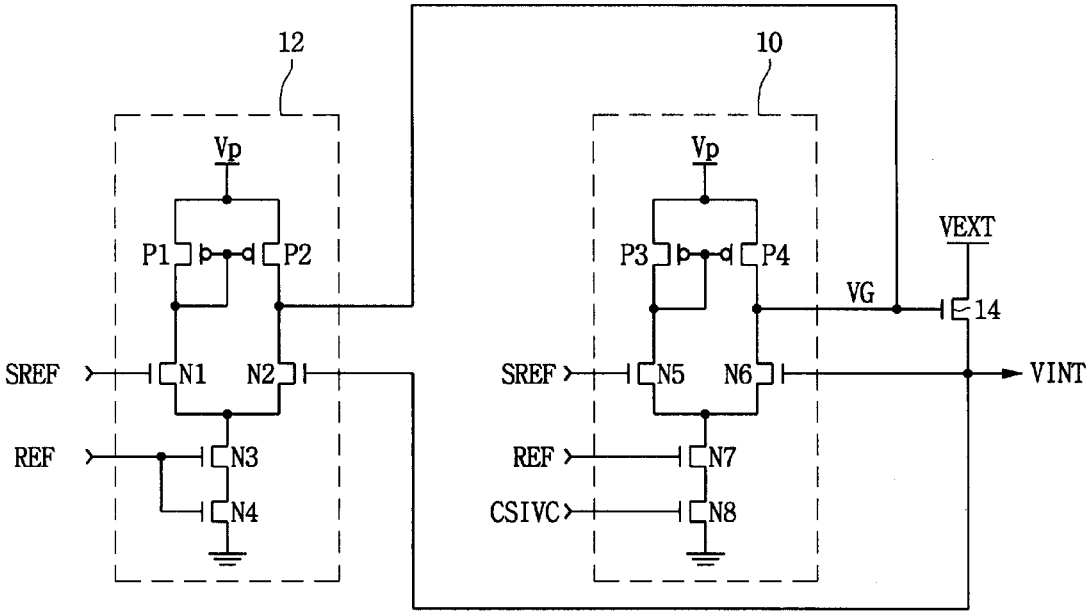
FIG. 6 is a circuit diagram showing more details of the circuit of FIG. 5.

The operation of the circuit of FIG. 6, which is a circuit diagram showing more details of the circuit of FIG. 5, will now be described. The operation of the circuit of FIG. 6 is similar to that of FIG. 2 with the following exceptions. During standby mode, the differential comparison circuit 12 for standby mode generates an output signal which is applied to the gate of output driver 14 to equalize the internal power voltage VINT to the level of the comparative reference voltage SREF. Although it is difficult for the circuit 12 to control the large NMOS transistor output driver 14, it is possible to do so because little current is consumed during standby mode. Therefore, the embodiment of an internal power voltage generating circuit in accordance with the present invention shown in FIGS. 5 and 6 can reduce current consumption during standby mode. Furthermore, the inverter 18 and additional transistor 20 shown in FIG. 1 are eliminated. The switching time from standby mode to active mode is also reduced.

Figure 7:
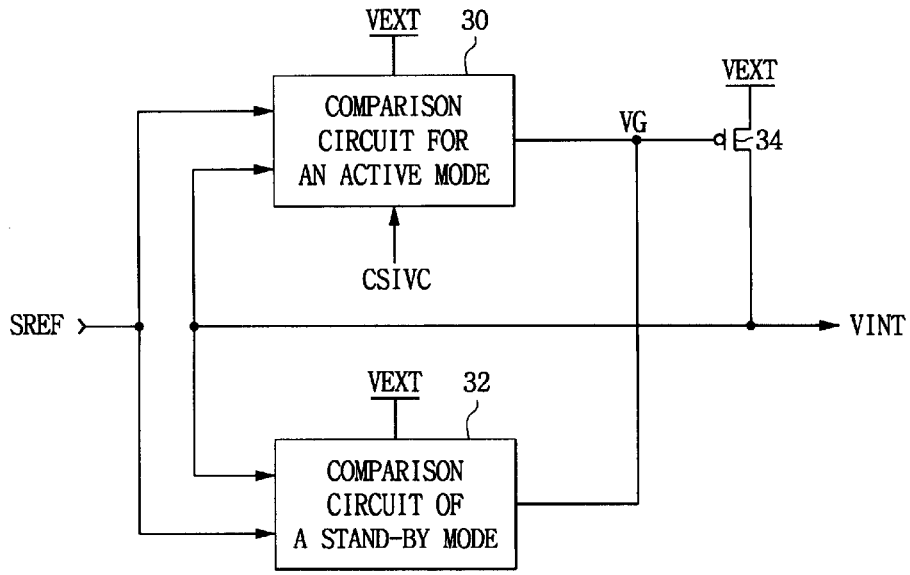
FIG. 7 is a block diagram of an embodiment of an internal power voltage generating circuit in accordance with the present invention having a PMOS transistor for an output driver.
Figure 8:
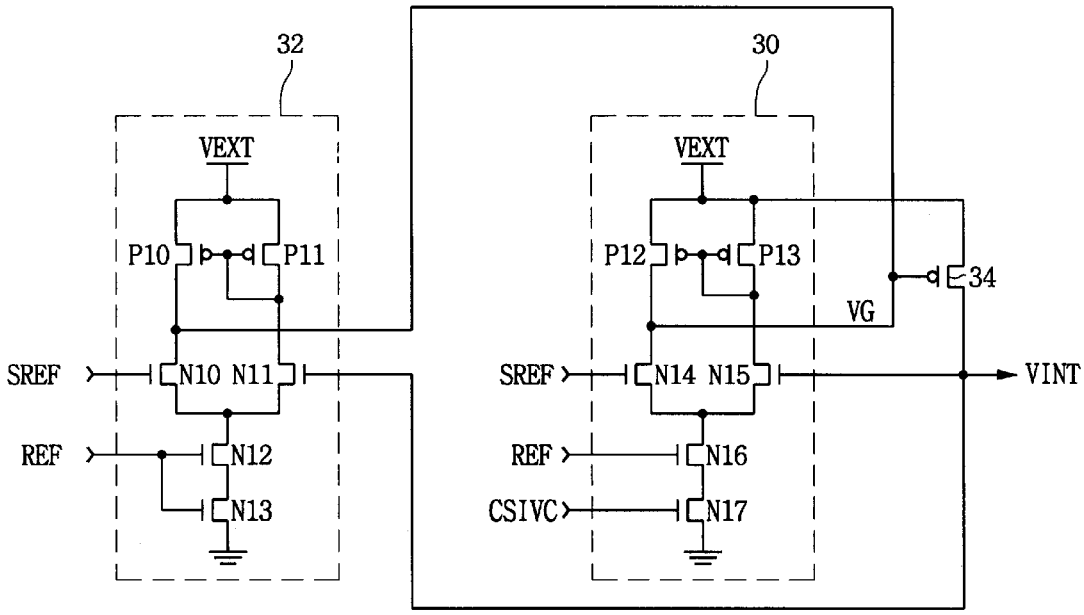
FIG. 8 is a circuit diagram showing more details of the circuit of FIG. 7.

FIG. 7 is a block diagram of a second embodiment of an internal power voltage generating circuit in accordance with the present invention using a PMOS transistor for an output driver. FIG. 8 is a circuit diagram showing more details of the circuit of FIG. 7. The operation of the circuit of FIGS. 7 and 8 is similar to that of FIGS. 3 and 4 with the following exceptions. Because the output signals from both differential comparison circuits 30 and 32 are used to drive the output driver 34, the additional transistor 38 of FIGS. 3 and 4 is eliminated. During active mode, the output driver 34 is driven by both the differential comparison circuits 30 and 32. Since the transistors in circuit 32 are much smaller than those in circuit 30, the signal from circuit 32 does not influence the driving of the output driver 34 by the circuit 30. In the standby mode, circuit 30 is disabled and output driver 34 is driven entirely by the output signal from circuit 32. Although it is difficult for the differential comparison circuit 32 to drive the large PMOS transistor 34, it is possible to do so due to the small amount of current consumed during standby mode. Because the output driver 34 is turned partially on during standby mode, it can switch rapidly to the completely on state during the transition from standby mode to active mode.

Having described and illustrated the principles of the invention in a preferred embodiment thereof, it should be apparent that the invention can be modified in arrangement and detail without departing from such principles. We claim all modifications and variations coming within the spirit and scope of the following claims.

What is claimed is:

1. An internal power voltage generating circuit comprising:

a first differential comparison circuit for generating a first output signal by comparing a comparative reference voltage and an internal power voltage during an active mode, wherein the first differential comparison circuit is enabled in response to a control signal;

a second differential comparison circuit for generating a second output signal by comparing a comparative reference voltage and the internal power voltage during a stand-by mode; and an output driver coupled to the first and second differential comparison circuits for generating the internal power voltage responsive to the first and second output signals;

wherein the output driver is a single large transistor.

2. An internal power voltage generating circuit comprising:

a first differential comparison circuit coupled between a power supply ground and a stepped-up power supply voltage for generating a first output signal by comparing a comparative reference voltage and an internal power voltage during an active mode;

a second differential comparison circuit coupled between the power supply ground and the stepped-up power supply voltage for generating a second output signal by comparing a comparative reference voltage and the internal power voltage during the active mode and a stand-by mode; and an NMOS output transistor coupled between an external power voltage and the internal power voltage and coupled to the first and second differential comparison circuit to generate the internal power voltage responsive to the first and second output signals;

wherein the NMOS output driver is a single large NMOS transistor.

3. An internal power voltage generating circuit comprising:

a first differential comparison circuit coupled between a power supply ground and an external voltage for generating a first output signal by comparing a comparative reference voltage and an internal power voltage during an active mode;

a second differential comparison circuit coupled between the power supply ground and the external voltage for generating a second output signal by comparing a comparative reference voltage and the internal power voltage during the active mode and a stand-by mode; and a PMOS output driver coupled between the external power voltage and the internal power voltage and coupled to the first and second differential comparison circuit to generate the internal power voltage responsive to the first and second output signals;

wherein the PMOS output driver is a single large PMOS transistor.

* * * * *